US006836637B2

(12) United States Patent
Kelsay

(10) Patent No.: US 6,836,637 B2
(45) Date of Patent: Dec. 28, 2004

(54) IMAGE FUSING APPARATUS AND METHODS

(75) Inventor: Curtis Greg Kelsay, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/403,723

(22) Filed: Mar. 31, 2003

(65) Prior Publication Data

US 2004/0190953 A1 Sep. 30, 2004

(51) Int. Cl.[7] ..... G03G 15/20
(52) U.S. Cl. ..... 399/330; 399/328
(58) Field of Search ..... 399/320, 328, 399/329, 330, 335, 338; 347/156

(56) References Cited

U.S. PATENT DOCUMENTS 4,493,982 A 1/1985 Romansky
5,115,278 A * 5/1992 Maruta et al. ..... 399/329
5,300,999 A * 4/1994 Koh et al. ..... 399/329
5,303,016 A * 4/1994 Oda et al. ..... 399/329
5,365,314 A * 11/1994 Okuda et al. ..... 399/329 X
5,660,750 A * 8/1997 Kusaka ..... 399/329 X
6,090,305 A 7/2000 Balch et al.

* cited by examiner

*Primary Examiner*—Sandra L. Brase

(57) ABSTRACT

Apparatus and methods in accordance with the present invention relate to fusing of images to image carrying media. Apparatus can include a circulatable contact element, a thermal insulator and a heating device. The contact element can be configured to circulate about the insulator and heating device, wherein the insulator is positioned substantially proximate an inner surface of the contact element, and further wherein the heating element is positioned between the inner surface of the contact element and the insulator. Methods include operating such a heating element to produce heat and directing the heat to flow toward the images and/or the image carrying media by way of the thermal insulator.

24 Claims, 5 Drawing Sheets

IMAGE FUSING APPARATUS AND METHODS

BACKGROUND OF THE INVENTION

Various types of imaging apparatus are known in the art. The term "imaging apparatus" generally encompasses any type of device that is capable of producing an image by depositing an imaging substance on an image carrier, or imaging media. Such imaging media is typically in the form of paper sheets. Imaging substance is typically in the form of liquid ink or powdered toner.

Some types of imaging apparatus include subsystems known as "fusers" or "fusing apparatus." These fusers are employed to fix, or fuse, the imaging substance to the imaging media. For example, one type of imaging process which is presently popular is that known by the name, "electrophotographic imaging process," among other names.

Imaging apparatus that employ the electrophotographic imaging process are commonly known by the name "laser printer" because such apparatus typically employ at least one laser for operation. However, not all electrophotographic imaging apparatus employ lasers. Some such apparatus employ light-emitting diodes in place of the laser, for example.

In any case, nearly all electrophotographic imaging apparatus incorporate a fusing apparatus of some type. Usually, the fusing process involves applying heat energy and/or pressure to a sheet of imaging media which has a toner image supported thereon. The typical fusing apparatus is in the form of a pair of rollers or the like that form a nip point through which the imaging media is passed.

At least one of the rollers is typically heated. As the imaging media passes between the rollers, the toner is heated and changes from a powdered state to a plastic state. Furthermore, pressure is typically applied to the imaging media by the rollers. Upon cooling of the toner after passing through the fusing apparatus, the toner solidifies, and in the process becomes substantially bonded to the imaging media.

Many conventional fusing apparatus employ a ceramic heating element that, while providing satisfactory operation, is relatively fragile and prone to cracking.

What is needed then, is a fusing apparatus, as well as an imaging apparatus employing such a fusing apparatus, that achieve the benefits to be derived from similar prior art apparatus and methods, but which avoid the shortcomings and detriments individually associated therewith.

SUMMARY OF THE INVENTION

In accordance with the present invention, a fusing apparatus can include a circulatable contact element. The contact element has an outer surface and an inner surface. The fusing apparatus can also include a thermal insulator that is located substantially proximate the inner surface of the contact element. The thermal insulator is configured to resist the flow therethrough of thermal energy such as heat. The fusing apparatus can also include heating device operatively disposed between the thermal insulator and the inner surface of the contact element. The heating device is configured to produce thermal energy, or heat. The configuration of the thermal insulator and its location relative to the heating device and the contact element can serve to direct the flow of heat energy produced by the heater in conjunction with fusing images.

DETAILED DESCRIPTION OF THE INVENTION

The present invention generally includes apparatus and methods for fusing images to image carrying media. Apparatus in accordance with various embodiments of the present invention include a circulatable contact element that has an outer surface and an inner surface, wherein the outer surface is configured to contact the image and/or the media and to transmit heat energy thereto while in contact therewith. An apparatus in accordance with at least one embodiment of the present invention can also include a thermal insulator that is configured to resist the flow of heat energy therethrough and is operatively positioned substantially proximate the inner surface of the contact element. A heating device can also be included in such an apparatus, wherein the heating device is configured to produce heat energy and can be located substantially between the thermal insulator and the inner surface of the contact element. Thus, the thermal insulator can serve to reduce transmission of heat energy from the heating device to areas other than the media and/or image during image fusing processes.

Figure 1:
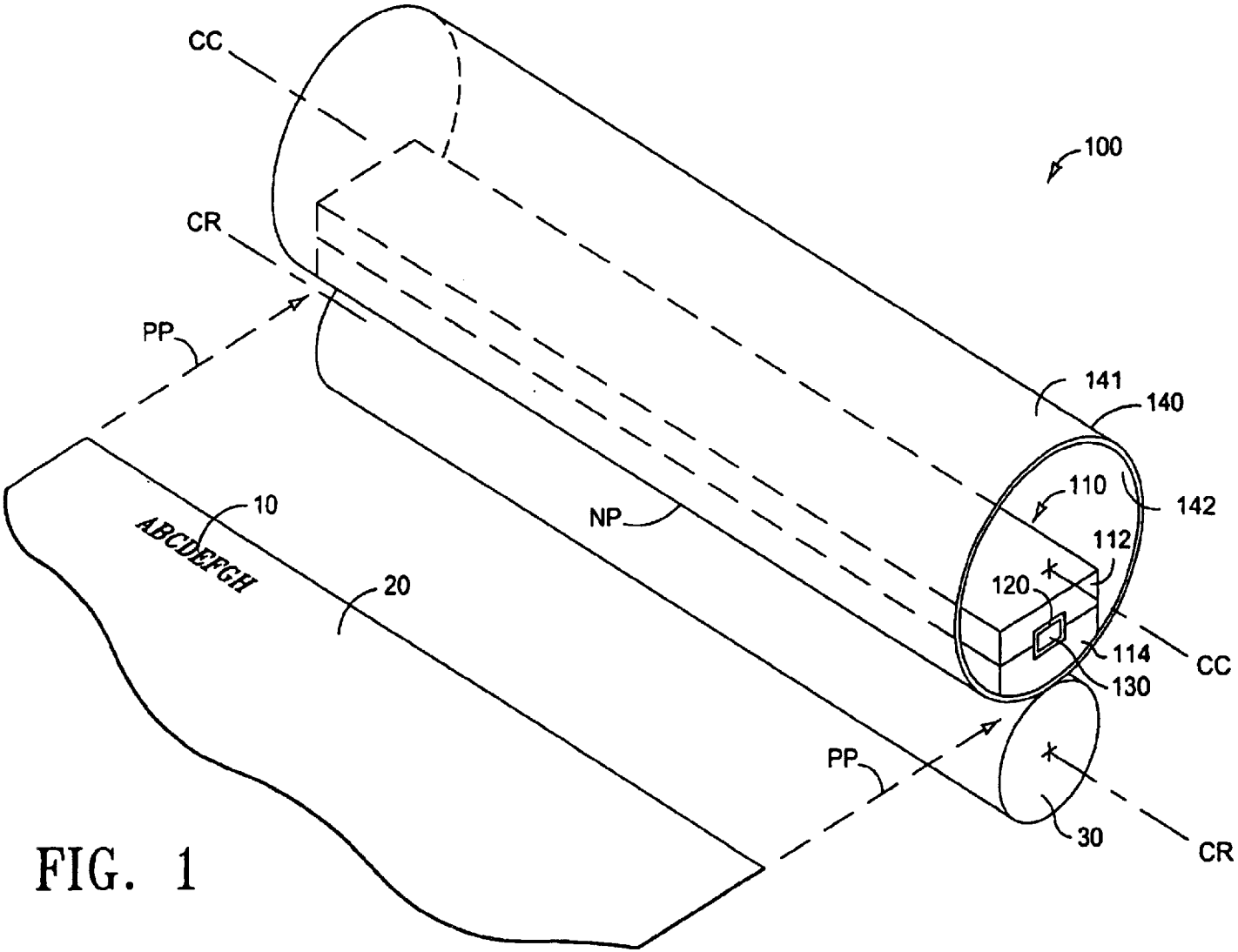
FIG. 1 is an isometric view in which a fusing apparatus in accordance with one embodiment of the present invention is depicted.

Turning to FIG. 1, an isometric view is shown in which a fusing apparatus 100 is depicted in accordance with one embodiment of the present invention. The fusing apparatus 100 is generally intended to be employed for fusing, or fixing, images such as the image 10 to a sheet media 20. The sheet media 20 can be conveyed along a media path PP. The media path PP can be positioned relative to the apparatus 100 so that the sheet media 20 and image 10 supported thereon will pass in substantially close proximity to the apparatus as is explained in greater detail below.

The apparatus 100 includes a heater carrier 110. The heater carrier 110 in turn includes a thermal insulator 112. The thermal insulator 112 is configured to resist the flow therethrough of thermal energy, or heat. The thermal insulator 112 can be fabricated from any of a number of known substances which have the desired thermally resistive properties. Likewise, the thermal insulator 112 can be constructed in any of a number of known manners which can facilitate the intended purpose thereof.

The heater carrier 110 can also include a thermal conductor 114. The thermal conductor 114 is configured to transmit the flow therethrough of thermal energy, or heat. Thus, while the thermal insulator 112 is configured to substantially block the flow of heat energy therethrough, the thermal conductor 114 is conversely configured to promote the flow of heat energy therethrough. The thermal conductor 114 can be fabricated from a number of known materials, and can be constructed in any of a number of known manners, wherein such materials and manners of construction can facilitate the intended purpose of the thermal insulator. By way of example only, the thermal conductor 114 can be an extrusion fabricated from aluminum.

The thermal insulator 112 and the thermal conductor 114 can be positioned substantially adjacent to one another, as is shown. Furthermore the thermal insulator 112 and/or the thermal conductor 114 can be substantially elongated as is also depicted. Additionally, a void 120 can be defined between the thermal insulator 112 and the thermal conductor 114. The void 120 can be substantially enclosed by the thermal insulator 112 and the thermal conductor 114. That is, the void 120 can be substantially in the form of a cavity or tunnel defined between the thermal insulator 112 and the thermal conductor 114.

The apparatus 100 can also include a heating device 130. As is depicted, the heating device 130 can be operatively disposed within the void 120. That is, the heating device 130 can be positioned within the void 120 so as to operate in the manner described below while positioned within the void. The heating device 130 is configured to convert power, such as electrical power, to heat energy. That is, the heating device 130 is configured to produce heat energy. The heating device 130 can have any of a number of possible specific forms. For example, the heating device 130 can be a light bulb. Light bulbs are known in the art and are known to produce heat energy. As yet a more specific example, the heating device 130 can be a halogen light bulb. Other more specific configurations of the heating device 130 are discussed in greater detail below.

The apparatus 100 can also include a contact element 140. The contact element 140 is configured so as to be circulatable. That is, the term "circulatable" as used herein is defined as moving relative to the heating device 130. Thus, the contact element 140 is configured to move, or circulate, relative to the heating device 130. The contact element 140 can be endless. That is, by way of example only, the contact element 140 can be in the form of a belt, a film, a tube, or the like, that can circulate endlessly relative to the heating device 130. Moreover, the contact element 140 can be either flexible or substantially rigid.

The contact element 140 can be configured to circulate about a center of circulation CC. Additionally, the contact element 140 can have an inner surface 142 defined thereon, as well as an outer surface 141. As is seen, the inner surface 142 can be substantially opposite the outer surface 141. Furthermore, the inner surface 142 and the outer surface 141 can be oriented in substantially parallel, juxtaposed relation with respect to one another.

The heater carrier 110 can be positioned within the contact element 140. That is, the heater carrier 110 can be positioned relative to the contact element 140 such that the contact element substantially surrounds the heater carrier. In such a manner, the contact element 140 can circulate around the heater carrier 110. More specifically, the thermal insulator 112 can be positioned within contact element 140, as can the thermal conductor 114. Likewise, the heating device 130 can similarly be positioned within the contact element 140. As is also depicted, the heater carrier 110, when in a substantially elongated form, can be oriented so as to be substantially parallel to the center of circulation CC.

The apparatus 100 can also include a pressure roller 30. The pressure roller 30 can be in the form of an elongated cylindrical roller that is configured to rotate about a center of rotation CR as is depicted. The pressure roller 30 and the contact element 140 can be positioned relative to one another as is depicted wherein the center of circulation is substantially parallel to the center of rotation CR.

Furthermore, the pressure roller 30 can be positioned substantially proximate the outer surface 141 of the contact element 140 so as to form a nip point NP there between. The contact element 140 and the pressure roller 30 can be configured to circulate and rotate, respectively, in the directions indicated. In this manner, the print path PP can be configured to convey the sheet media 20 there along and into the nip point NP defined between the contact element 140 and the pressure roller 30.

The sheet media 20 can continue to pass between the contact element 140 and the pressure roller 30 so as so eventually completely pass through the nip point NP. The pressure roller 30 can be configured to press against the contact element 140 with a predetermined amount of force so as to apply a "squeezing" pressure to the sheet media 20 as it moves along the print path PP and between the contact element and the pressure roller. Furthermore, the pressure roller 30 can be configured to be slightly pliable. In this manner, the force of the pressure roller 30 against the contact element 140 can facilitate the transfer of heat energy to the sheet media 20 through an increase in pressure of the contact element against the sheet media and/or an increase in the time that the sheet media remains in contact with the contact element as the sheet media passes through the nip point NP.

Figure 2:
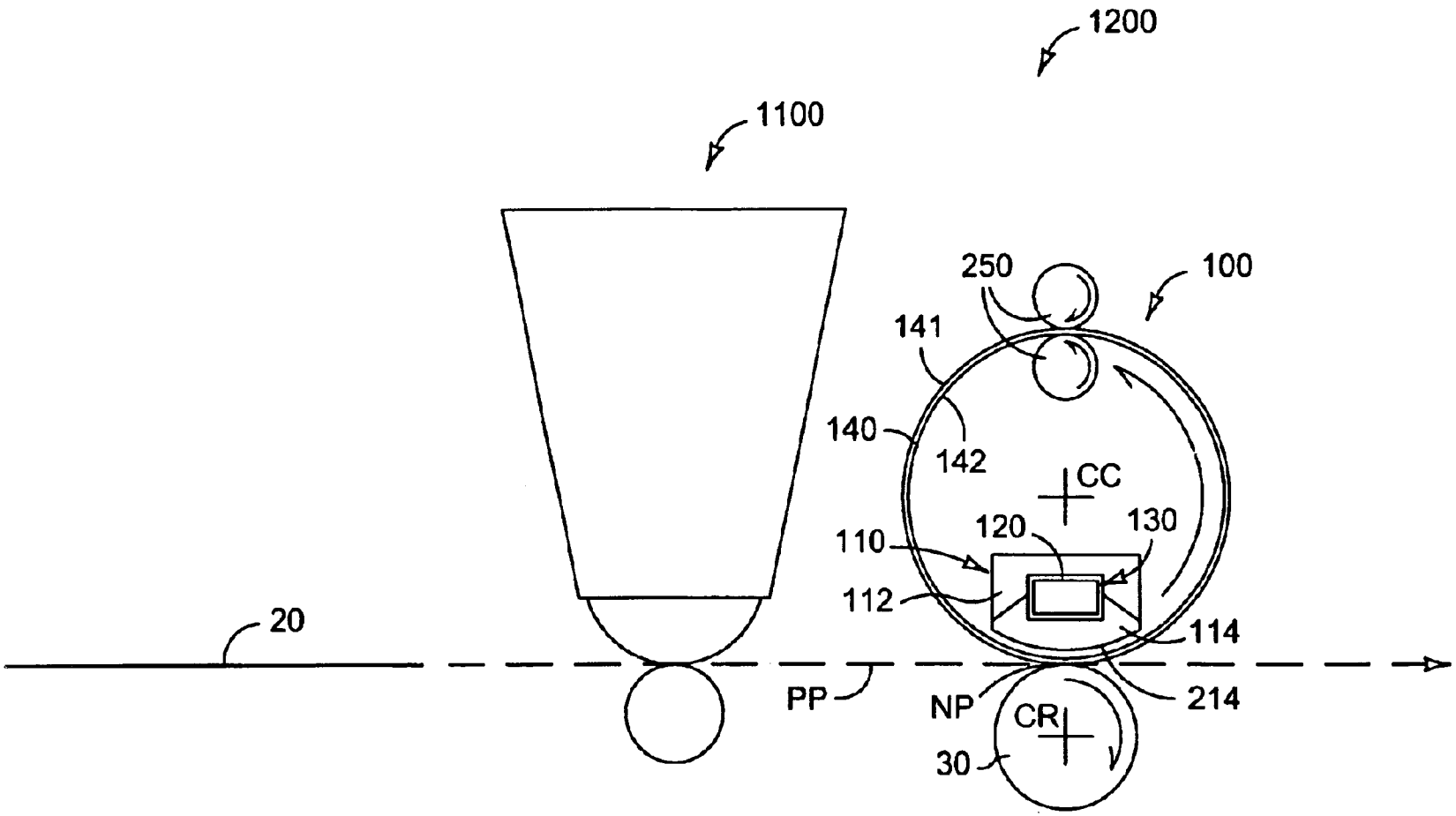
FIG. 2 is a side elevation view in which an imaging apparatus in accordance with another embodiment of the present invention is depicted.

Moving now to FIG. 2, a side elevation view is shown in which an imaging apparatus 1200 is depicted in accordance with another embodiment of the present invention. The imaging apparatus 1200 includes an imaging section 1100. The imaging apparatus 1200 can also include a fusing apparatus 100 which is described above. The imaging apparatus 1200 can also include a print path PP that is configured to convey there along a sheet media 20 as is depicted. As the sheet media 20 is conveyed along the print path PP, the sheet media can first pass by the imaging section 1100 and then can pass by the fusing apparatus 100.

The imaging section 1100 can be configured to form an image by depositing an imaging substance (not show) such as powdered toner or the like onto the sheet media 20. The process of forming images in such a manner, as well as in other manners, is well known in the art. After an image is formed on the sheet media 20, the sheet media with image formed thereon can be moved along the print path PP from the imaging section 1100 to the fusing apparatus 100. The fusing apparatus 100 is configured to fuse, or fix, the image to the sheet media 20 by applying heat to the imaging substance and, to the sheet media. As mentioned above, pressure is also typically applied to the imaging substance and/or to the sheet media as well. Such fusing processes are well known in the art.

As is mentioned above, the fusing apparatus 100 includes a heater carrier 110 that can include a thermal insulator 112 and can also include a thermal conductor 114. As is also explained above, a void 120 can be defined between the thermal insulator 112 and the thermal conductor 114, and a heating device 130 can be operatively positioned within the void. The purpose of the heating device 130 is to supply heat energy to be used in the fusing process which can be performed by the fusing apparatus 100 as is mentioned above.

As can be further seen, a transmission surface 214 can be defined on the thermal conductor 114. The transmission surface 214 can have any of a number of possible shapes, including that of a cylindrical surface. The thermal conductor 114 can be oriented in a manner whereby the transmission surface 214 substantially faces the inner surface 142 of the contact element 140. It is noted that the transmission surface 214 need not touch the contact element 140, as is revealed from a study of FIG. 2. However, the transmission surface 214 can be in contact with the inner surface 142 of the contact element 140 as is depicted in additional figures which are discussed below.

Additionally, the thermal conductor 114 can be oriented in a manner whereby the transmission surface not only faces the contact element 140, but also faces the print path PP. That is, the thermal conductor 114 can be positioned and oriented in a manner whereby the transmission surface 214 faces the inner surface 142 of the contact element 140 and is also substantially proximate the point where the print path PP passes the outer surface 141 of the contact element. Also, as is seen, the thermal conductor 140 can be positioned and oriented in a manner whereby the print path PP passes substantially between the pressure roller 30 and the transmission surface 214.

As is further indicated in FIG. 2, the apparatus 1200 can include a means 250 for circulating the contact element 140. The means 250 for circulating the contact element 140 can have any of a number of possible forms. For example, as is depicted, the means 250 for circulating the contact element 140 can include a pair of rollers that are configured to grip and move the contact element 140. Other forms and configurations of such means 250 for circulating the contact element are possible and are known in the art.

Thus, in operation, the means 250 for circulating the contact element 140 can be employed to induce the contact element to circulate in the direction indicated. Likewise, the pressure roller 30 can be made to rotate in the direction indicated. The heating device 130 can be operated so as to produce heat energy. Because of the location of the heating device 130 within the void 120 defined between the thermal insulator 112 and the thermal conductor 114, a substantial portion of the heat energy produced by the heating device can be directed to flow through the thermal insulator and thus through the transmission surface 214 and toward the print path PP.

In this manner, a substantial portion of the heat energy produced by the heating device 130 can be directed toward the sheet media 20 as the sheet media is conveyed along the print path PP and into the nip point NP. That is, because the thermal insulator 112 is configured to substantially resist the flow therethrough of thermal energy, and because the thermal conductor 114 is configured to facilitate the flow therethrough of thermal energy, then a substantially proportion of the thermal energy that is produced by the heating device 130 can be directed to flow through the thermal conductor and outwardly from the transmission surface 214. This thermal energy flowing from the transmission surface 214 can then flow through the contact element and into the sheet media 20 and the imaging substance (not shown) supported thereon in the form of an image.

Figure 3:
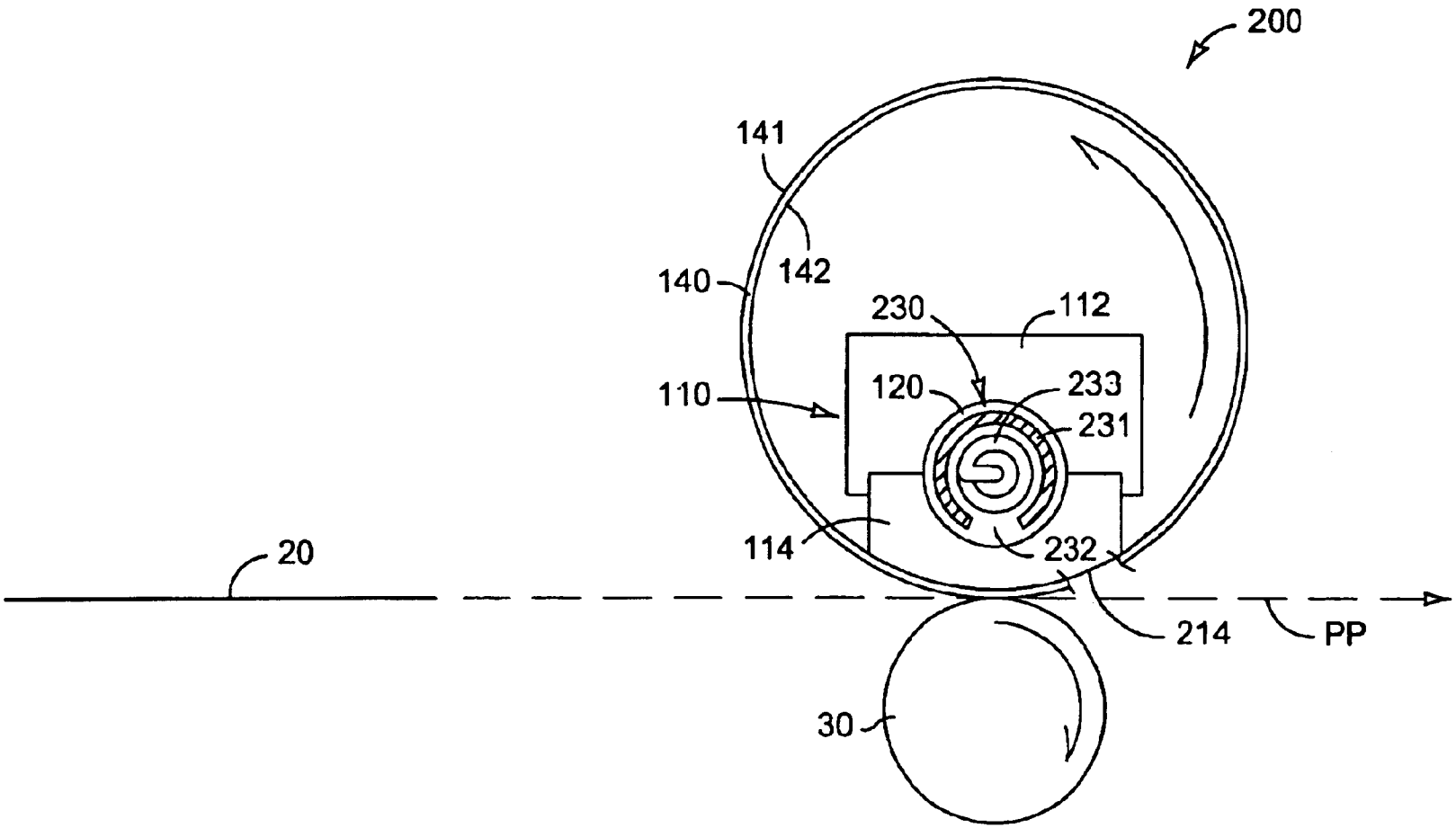
FIG. 3 is an end view in which a fusing apparatus in accordance with yet another embodiment of the present invention is depicted.

Turning now to FIG. 3, an end view is shown in which a fusing apparatus 200 is depicted in accordance with another embodiment of the present invention. As is seen, the fusing apparatus 200 can be substantially similar to the fusing apparatus 100 which is discussed above, with the exception of the configuration of the heating device, as is explained below. Furthermore, as is illustrated in FIG. 3, the respective shapes of the thermal insulator 112 and the thermal conductor 114, as well as the void 120, can be varied.

The apparatus 200 can include the circulatable contact element 140 which is described above. Furthermore, the apparatus 200 can include the heater carrier 110 which is also described above. The heater carrier 110, as well as the individual components thereof, can have any of a number of different shapes as is seen from a study of the various figures included herein.

Also, as mentioned above, the transmission surface 214 can be defined on the thermal conductor 114, and can be seen through the cutaway of the contact member 140. That is, it is understood that a "break" is shown in the contact member 140 for clarity although the contact member is depicted as being continuous. The heater carrier 110 can be oriented and positioned relative to the contact member 110 in a manner such that the transmission surface 214 is in substantial contact with the inner surface 142 of the contact member. More specifically, the transmission surface 214 can be in substantial contact with the inner surface 142 of the contact member 140, wherein the transmission surface also substantially faces the print path PP, as is depicted.

As is mentioned above, the heater carrier 110 can include both the thermal insulator 112 and the thermal conductor 114. Furthermore, the void 120 can be defined between the thermal insulator 112 and the thermal conductor 114. Within the void 120, a heating device 230 can be operatively disposed. The heating device 230 can be configured to function in a manner substantially similar to that of the heating device 130 as is described above.

The heating device 230 can include a heater element 233. The heater element 233 can be a metallic heater element. A number of various types of metallic heater elements are known in the art to produce substantial quantities of heat energy when an electrical current is passed therethrough. For example, the heater element 233 can be fabricated from either nickel or nichrome such as in the case of nickel wire or nichrome wire, respectively. Nickel and nichrome are known in the art to be satisfactory heating element materials. Furthermore, the heating element 233 can have any of a number of possible shapes. By way of example only, the heating element 233 can be a straight piece of wire, or can be helically coiled piece of wire, as is depicted.

The heating device 230 can include a housing 231 that substantially surrounds the heater element 233. For example, the housing 231 can be an elongated tube as is depicted. Furthermore, a gap 232 can be defined through the housing 231 as is also depicted. The gap 232 can be substantially longitudinal and can be substantially elongated as is depicted in FIG. 3.

Moreover, the housing 231 can be oriented relative to the heater carrier 110 in a manner wherein the gap 232 substantially faces the thermal conductor 114. Additionally, the housing 231 can be oriented so that the gap 232 substantially faces the print path PP as is also depicted. The housing 231 can be fabricated from any of a number of different materials. For example, the housing 231 can be fabricated from a ceramic material. By way of further example, the housing 231 can be fabricated from mica or silicone.

Figure 4:
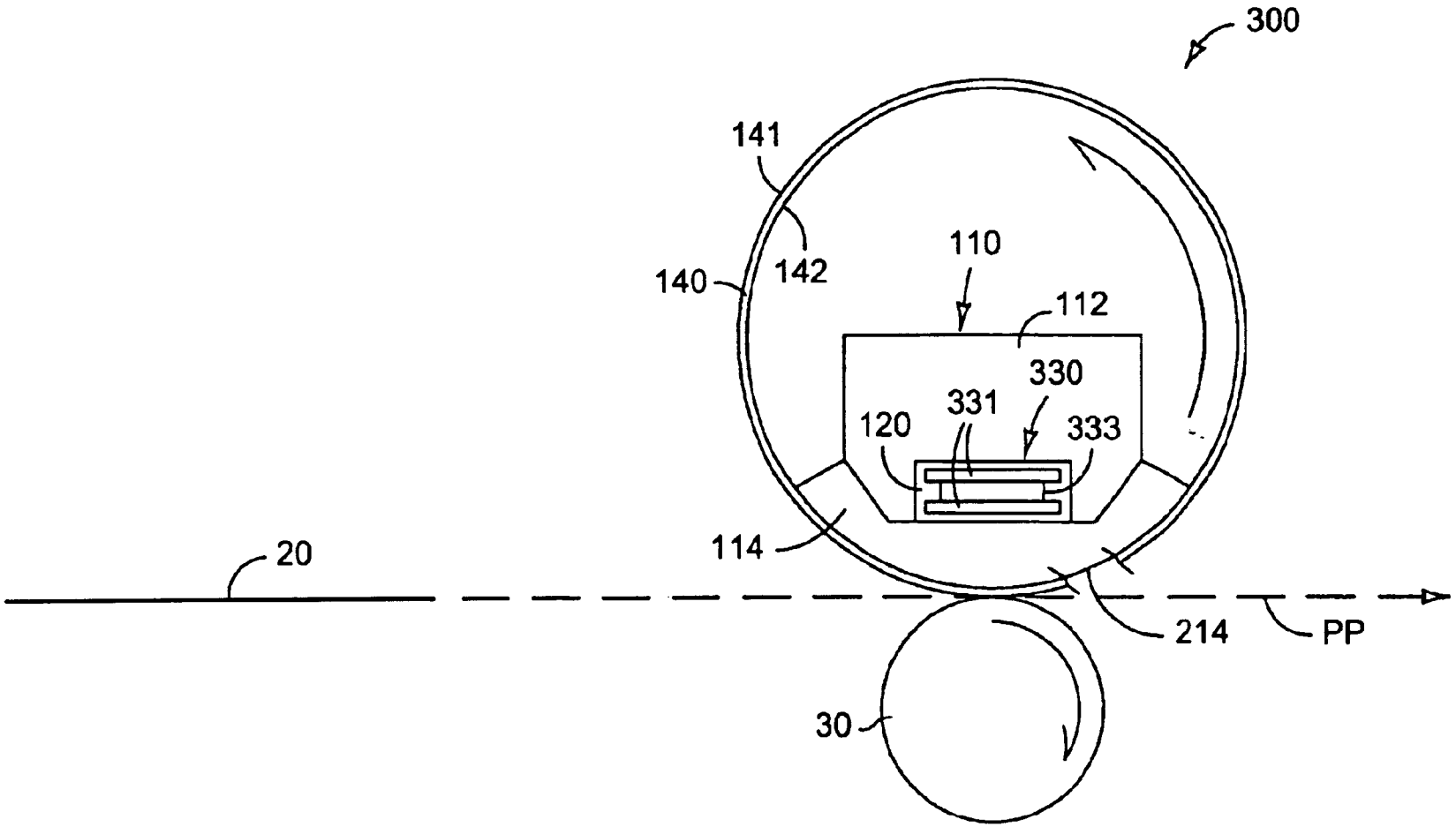
FIG. 4 is an end view in which a fusing apparatus in accordance with still another embodiment of the present invention is depicted.

Turning to FIG. 4, another end view is shown in which a fusing apparatus 300 is depicted in accordance with another embodiment of the present invention. The fusing apparatus 300 can be substantially similar to the fusing apparatus 100 and 200 which are described above, with the exception of the configuration of the heating device as is described below. As is further illustrated by an examination of FIG. 4, the respective shapes of the thermal insulator 112, the thermal conductor 114, as well as the void 120 can be varied.

The fusing apparatus 300 can include the circulatable contact element 140 which is described above, and which defines thereon an inner surface 142 and an outer surface 141. Also, as mentioned above, the fusing apparatus 300 can include the heater carrier 110 which can include the thermal insulator 112 and the thermal conductor 114 which define therebetween the void 120. The transmission surface 214, which is also described above, can be defined on the thermal conductor 114. It is understood that a "break" is shown in the contact element 140 for clarity, although the contact element is depicted as being continuous.

Within the void 120, a heating device 330 can be operatively disposed. The heating device 330 can be configured to operate in a manner substantially similar to that of the heating device 130, as well as that of the heating device 230 which are both discussed above. The heating device 330 can be substantially in the form of a flat strip as is depicted. Furthermore, the heating device 330, when in such a flat strip form, can be oriented in a manner so as to be substantially parallel to a portion of the print path PP which is proximate to the outer surface 141 of the contact element 140.

That is, the print path PP can be positioned so that a portion of the print path is substantially proximate the heater carrier 110. This portion of the print path PP can be substantially flat or straight as is depicted. Accordingly, the heating device 330, having a substantially flat, strip form as described above, can be substantially parallel to the portion of the print path PP which passes substantially proximate the heater carrier 110.

The heating device 330 can include a heater element 333. The heater element 333 can be substantially flat, and can be in substantially strip form as is depicted. The heating device 330 can further include at least one layer 331. A pair of layers 331 can be included as is depicted. The heater element 333 can be sandwiched between the pair of layers 331 as is depicted. The layers 331 can be fabricated from any of a number of various materials. For example, the layers 331 can be ceramic paper layers. Alternatively, the layers 331 can be polyamide layers. Both ceramic paper and polyamide are materials which are known in the art.

Figure 5:
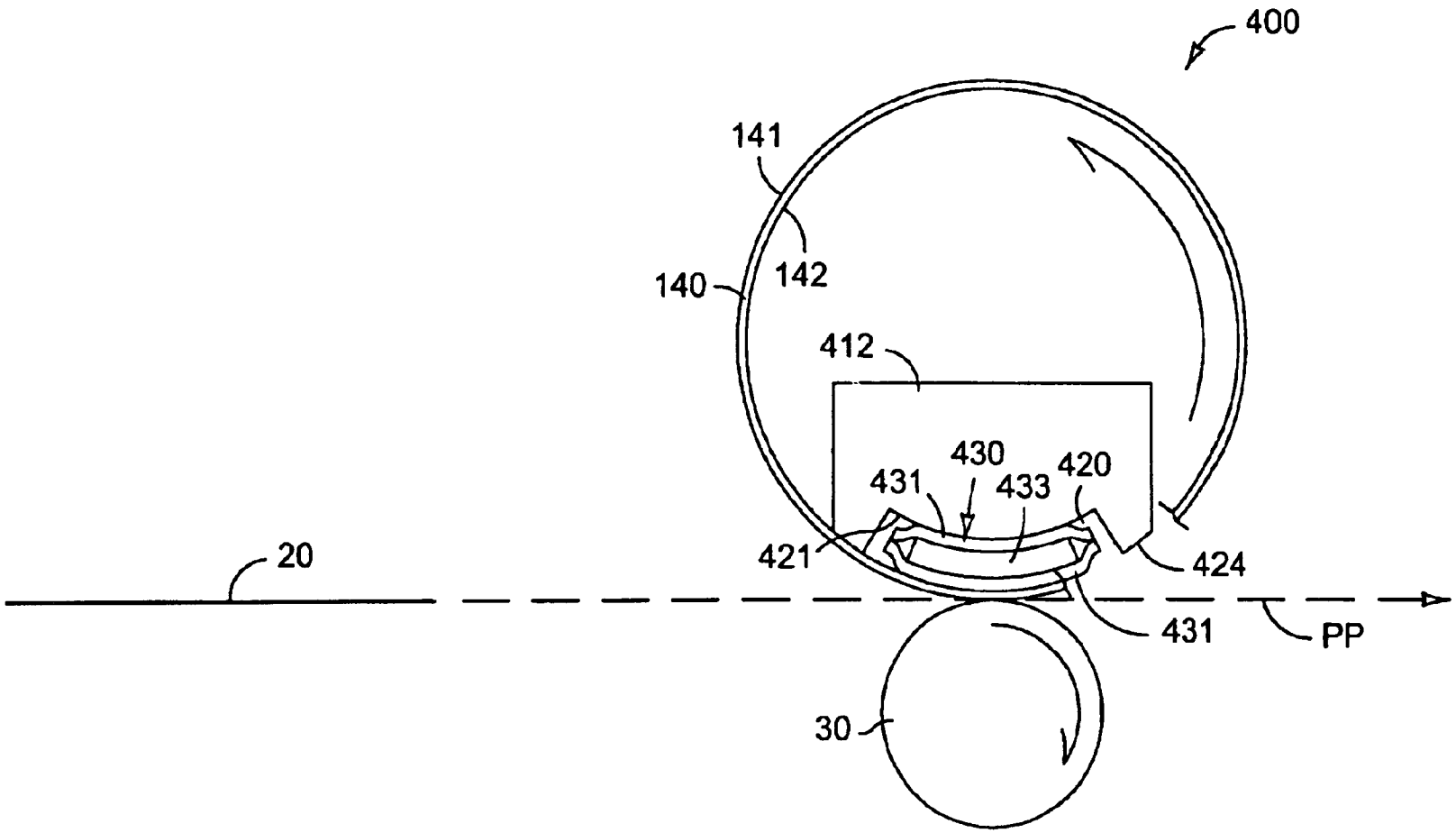
FIG. 5 is an end view in which a fusing apparatus in accordance with an additional embodiment of the present invention is depicted.

Tuning now to FIG. 5, another end view is shown in which a fusing apparatus 400 is depicted in accordance with yet another embodiment of the present invention. The fusing apparatus 400 can be configured to operate in a manner substantially similar to that of the fusing apparatus 200 and 300 which are described above. That is, the fusing apparatus 400 can include the circulatable contact element 140 which is described above. As mentioned above, the contact element 140 has an outer surface 141 defined thereon, as well as an inner surface 142 defined thereon.

However, in accordance with the embodiment of the present invention depicted in FIG. 4, the fusing apparatus 400 need not include a thermal conductor. That is, the fusing apparatus 400, as depicted, includes a thermal insulator 412, but does not include a thermal conductor. The thermal insulator 412 can be substantially similar to the thermal insulator 112 which is described above, with the exception that the thermal insulator 412 need not be configured to employed in conjunction with a thermal conductor.

The thermal insulator 412 can be positioned substantially proximate the inner surface 142 of the contact element 140. Furthermore, the thermal insulator 412 can define thereon at least one guide surface 424. It is understood that a "break" is shown in the contact element 140 for clarity, although the contact element is depicted as being continuous. The guide surface 424 can be configured to contact the inner surface 142 of the contact member 140. However, it is understood that the thermal insulator 412 can be positioned in a manner so as to be spaced apart from the inner surface 142 of the contact element 140. That is, the thermal insulator 412 need not contact the contact element.

The fusing apparatus 400 can include a heating device 433. The heating device 433 can be substantially flat, and can be in substantially strip form as is shown. The heating device 433 can be operatively disposed between thermal insulator 412 and the inner surface 142 of the contact element 140. The thermal insulator 412 can define thereon a trough 420 as is depicted. The trough 420 can be substantially elongated and can be oriented substantially longitudinally relative to the thermal insulator 412, as is also depicted. The heating device 433 can be operatively nested within the trough 420 as shown. That is, the heating device 433 can be positioned either partially, or wholly, within the trough 420.

A backup surface 421 can be defined on the thermal insulator 412. The backup surface 421 can be configured to serve as a supportive surface for the heating device 430. That is, the backup surface 421 can act to supportively "back up" the heating device 430. The backup surface 421 can be substantially cylindrical. The term "cylindrical" as used herein is defined as characterized by a surface generated by a first line which always has a point in common with a given curve, whereby the first line is always parallel with a second line not in the plane of the curve.

As is seen from a study of FIG. 4, the heating device 433 can be adjacent to, and in substantially juxtaposed orientation relative to, the backup surface 421. For example, the heating device 433 can be configured to substantially conform to the shape of the backup surface 421. That is, as is seen, the backup surface 421 and the heating device 433 can have substantially the same curvature. Furthermore, the heating device 433 can also substantially conform to the shape of the inner surface 142 of the contact element 140.

Moreover, the heating device 430 can be substantially sandwiched between the backup surface 421 and the inner surface 142 of the contact element 140, wherein the heating device is in substantial contact with the inner surface of the contact element 140 and substantially conforms to the shape of the inner surface of the contact element. The heating device 430 can simultaneously be in contact with the backup surface 421 while also substantially conforming to the shape of the backup surface.

The heating device 430 can include a heater element 433. The heater element 433 can be a metallic heater element, and can also be substantially flat, and can be strip form. Furthermore, the heating device 430 can include at least one layer 431, and can include a pair of such layers. The heater element 433 can be sandwiched between a pair of the layers 431 as is depicted. The layers 431 can be fabricated from any of a number of materials. For example, the layers 431 can be polyamide layers. Alternatively, the layers 431 can be Teflon® layers.

In this manner, the fusing apparatus 400 can be operated so that the heating device 430 produces heat energy. The heating device 430 can be positioned so as to be substantially proximate the print path PP, which is described above. The heat energy produced by the heating device 430 can directed substantially toward the print path PP due to the thermal insulation properties of the thermal insulator 412. That is, because the thermal insulator 412 is configured to resist the flow therethrough of thermal energy, a substantial portion of any thermal energy produced by the heating device 430 can be directed toward the print path PP to facilitate fusing processes performed on the sheet media 20.

In accordance with yet another embodiment of the present invention, a method of fusing an image to sheet media can include providing a thermal insulator such as the thermal insulators described above with respect to the apparatus 100, 200, 300, and 400. Furthermore, a heating device can be provided, wherein such a heating device can be substantially similar to the heating devices described above with respect to the apparatus 100, 200, 300, 400. Furthermore, a circulatable contact element such as the contact element 140 can be provided.

In accordance with the method, the thermal insulator can be positioned proximate the inner surface of the contact element. Furthermore, the heating device can be positioned between the thermal insulator and the inner surface of the contact element. In this manner, the heating device can be operated to produce heat energy that can be employed to fuse an image to sheet media.

Also in accordance with the method, a thermal conductor can be provided. The thermal conductor can be substantially similar to the thermal conductor of either of the apparatus 100, 200, 300, or 400 which are described above. The thermal conductor can be positioned between the heating device and the inner surface of the contact element, wherein the thermal conductor is in substantial contact with the contact element. The thermal conductor can also be in substantial contact with the heating device as well as with the thermal insulator.

In this manner, the heating device can be operated to produce heat energy, whereby flow of the heat energy is substantially blocked by the thermal insulator. However, the heat energy can be allowed to flow substantially through the thermal conductor and also through the contact element so as to be employed to fuse an image to a sheet media.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An electrophotographic image fusing apparatus, comprising:

a circulatable contact element that defines thereon an outer surface and an inner surface;

a thermal conductor that defines thereon a transmission surface that substantially faces the inner surface of the contact element;

a thermal insulator adjacent to the thermal conductor substantially opposite of the transmission surface, wherein an elongated, substantially enclosed void is defined between the thermal conductor and the thermal insulator;

a heating device operatively disposed within the void; and, an elongated housing disposed within the void, wherein the housing substantially surrounds the heating device.

2. The apparatus of claim 1, and wherein the heating device is a light bulb.

3. The apparatus of claim 2, and wherein the light bulb is a halogen light bulb.

4. The apparatus of claim 1, and wherein the heating device comprises a metallic heater element.

5. The apparatus of claim 4, and wherein the heater element is fabricated from a material selected from the group consisting of nickel and nichrome.

6. The apparatus of claim 4, and further comprising a media path configured to convey there along sheets of media, at least a portion of which media path is proximate the outer surface of the contact element, and wherein:

the heating device is substantially in the form of a flat strip; and, the heating device is substantially parallel to the portion of the media path that is proximate the outer surface of the contact element.

7. The apparatus of claim 6, and wherein the heating device further comprises a pair of polyamide layers between which the heating device is sandwiched.

8. The apparatus of claim 1, and wherein the thermal conductor is fabricated from a material comprising extruded aluminum.

9. An electrophotographic image fusing apparatus, comprising:

a circulatable contact element that defines thereon an outer surface and an inner surface:

a thermal conductor that defines thereon a transmission surface that substantially faces the inner surface of the contact element;

a thermal insulator adjacent to the thermal conductor substantially opposite of the transmission surface, wherein an elongated, substantially enclosed void is defined between the thermal conductor and the thermal insulator; and, a heating device operatively disposed within the void, wherein the heating device comprises:

a metallic heater element; and, an elongated housing that substantially surrounds the heater element.

10. The apparatus of claim 9, and wherein the housing is fabricated from a material selected from the group consisting of ceramics, mica, and silicone.

11. The apparatus of claim 9, and wherein:

the housing is substantially in the form of a cylindrical tube;

a substantially longitudinal gap is defined through the tube; and, the gap substantially faces the thermal conductor.

12. An electrophotographic image fusing apparatus, comprising:

a circulatable contact element that defines thereon an outer surface and an inner surface;

a thermal conductor that defines thereon a transmission surface that substantially faces the inner surface of the contact element;

a thermal insulator adjacent to the thermal conductor substantially opposite of the transmission surface, wherein an elongated, substantially enclosed void is defined between the thermal conductor and the thermal insulator;

a heating device substantially in the form of a flat strip operatively disposed within the void, wherein the heating device comprises a metallic heating element and a pair of ceramic paper layers between which the heater element is sandwiched, and, a media path configured to convey there along sheets of media, at least a portion of which media path is proximate the outer surface of the contact element, and wherein the heating device is substantially parallel to the portion of the media path that is proximate the outer surface of the contact element.

13. An electrophotographic image fusing apparatus, comprising:

a circulatable contact element that defines thereon an outer surface and an inner surface;

a thermal insulator substantially proximate the inner surface of the contact element;

a heating device operatively disposed between the thermal insulator and the inner surface of the contact element; and, an elongated housing disposed between the thermal insulator and the inner surface of the contact element, wherein the housing substantially surrounds the heating device.

14. The apparatus of claim 13, and wherein:

the thermal insulator defines thereon a substantially longitudinal trough; and, the heating device is operatively nested within the trough.

15. An electrophotographic image fusing apparatus, comprising:

a circulatable contact element that defines thereon an outer surface and an inner surface;

a thermal insulator substantially proximate the inner surface of the contact element, wherein a substantially cylindrical backup surface is defined on the thermal insulator; and, a heating device substantially in strip form and operatively disposed between the thermal insulator and the inner surface of the contact element, wherein:

the heating device is adjacent to, and in substantially juxtaposed orientation relative to, the backup surface; and, the heating device substantially conforms to the shape of the backup surface.

16. The apparatus of claim 15, and wherein:

the heating device is substantially sandwiched between the backup surface and the inner surface of the contact element; and, the heating device is in contact with the inner surface of the contact element and substantially conforms to the shape of the inner surface of the contact element.

17. An electrophotographic image fusing apparatus, comprising:

a circulatable contact element that defines thereon an outer surface and an inner surface;

a thermal insulator substantially proximate the inner surface of the contact element; and, a heating device comprising a metallic heater element in substantial strip form and a pair of polyamide layers between which the heater element is sandwiched, wherein the heating device is operatively disposed between the thermal insulator and the inner surface of the contact element.

18. An electrophotographic image fusing apparatus, comprising:

a circulatable contact element that defines thereon an outer surface and an inner surface;

a thermal insulator which defines thereon a substantially longitudinal trough and a substantially cylindrical backup surface within the trough, wherein the thermal insulator is substantially proximate the inner surface of the contact element; and.

a heating device in substantially strip form and operatively nested within the trough, thereby being disposed between the thermal insulator and the inner surface of the contact element, and being adjacent to, and in substantially juxtaposed orientation relative to, the backup surface, wherein the heating device substantially conforms to the shape of the backup surface.

19. The apparatus of claim 18, and wherein the heating device comprises:

a metallic heater element in substantially strip form; and, a pair of polyamide layers between which the heater element is sandwiched.

20. An imaging apparatus, comprising:

an imaging section configured to form an image by depositing an imaging substance onto sheet media; and, a fusing apparatus configured to fuse the imaging substance to the sheet media, the fusing apparatus comprising:

a circulatable contact element that defines thereon an outer surface and an inner surface;

a thermal insulator;

a heating device; and, an elongated housing substantially proximate the thermal insulator and the contact element, wherein:

the housing is between the thermal insulator and the inner surface of the contact element; and, the housing substantially surrounds the heating device.

21. The imaging apparatus of claim 20, and further comprising a thermal conductor between the housing and the inner surface of the contact element.

22. The imaging apparatus of claim 21, and further comprising a means for circulating the contact element.

23. A method for fusing an image to sheet media, the method comprising:

providing a thermal insulator;

providing a heating device;

providing an elongated housing;

providing a circulatable contact element that defines thereon an outer surface and an inner surface;

positioning the thermal insulator proximate the inner surface of the contact element; and, positioning the housing between the thermal insulator and the inner surface of the contact element, wherein the housing substantially surrounds the heating device.

24. The method of claim 23, and further comprising:

providing a thermal conductor; and, positioning the thermal conductor between the housing and the inner surface of the contact element, wherein the thermal conductor is in substantial contact therewith.

* * * * *